US010047604B2

(12) United States Patent
Graves et al.

(10) Patent No.: US 10,047,604 B2
(45) Date of Patent: Aug. 14, 2018

(54) SYSTEM FOR TRACKING AND SAMPLING WELLBORE CUTTINGS USING RFID TAGS

(71) Applicant: Halliburton Energy Services, Inc., Houston, TX (US)

(72) Inventors: Walter Varney Andrew Graves, Lafayette, LA (US); Clinton Cheramie Galliano, Houma, LA (US); Mathew Dennis Rowe, Lafayette, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 182 days.

(21) Appl. No.: 14/787,730

(22) PCT Filed: Aug. 28, 2013

(86) PCT No.: PCT/US2013/057117
§ 371 (c)(1),
(2) Date: Oct. 28, 2015

(87) PCT Pub. No.: WO2015/030755
PCT Pub. Date: Mar. 5, 2015

(65) Prior Publication Data

US 2016/0160640 A1 Jun. 9, 2016

(51) Int. Cl.

| | |
|---|---|
| ***E21B 49/00*** | (2006.01) |
| ***E21B 47/10*** | (2012.01) |
| ***E21B 21/08*** | (2006.01) |
| ***E21B 47/00*** | (2012.01) |

(52) U.S. Cl.
CPC ..... *E21B 49/003* (2013.01); *E21B 21/08* (2013.01); *E21B 47/0007* (2013.01); *E21B 47/10* (2013.01); *E21B 47/1015* (2013.01); *E21B 49/005* (2013.01)

(58) Field of Classification Search
None
See application file for complete search history.

(56) References Cited

U.S. PATENT DOCUMENTS

| | | | | |
|---|---|---|---|---|
| 5,991,602 | A * | 11/1999 | Sturm | E21B 47/12 455/40 |
| 6,176,323 | B1 | 1/2001 | Weirich et al. | |
| 7,040,402 | B2 | 5/2006 | Vercaemer | |
| 2010/0044034 | A1* | 2/2010 | Bailey | E21B 47/1015 166/253.1 |

(Continued)

OTHER PUBLICATIONS

International Search Report and Written Opinion, dated May 14, 2014, 14 pages; Korean International Searching Authority.

*Primary Examiner* — Paul West
*Assistant Examiner* — Mark A Shabman
(74) *Attorney, Agent, or Firm* — Haynes and Boone, LLP

(57) ABSTRACT

A system and process for determining system operational characteristics of a drill string or completed well includes one or more detectors positioned along a fluid flow path in a wellbore. The detectors are operable to detect the presence of one or more transmitters circulated within the fluid flow path and to receive and record data based on detecting the transmitters. The system determines an operational characteristic, such as cutting sample identification information, flow rate, pump efficiency, lag, the presence of a washout, losses, or an equipment malfunction based on the data received and recorded by the detectors.

20 Claims, 3 Drawing Sheets

(56) References Cited

U.S. PATENT DOCUMENTS

| | | | | |
|---|---|---|---|---|
| 2010/0051266 | A1 | 3/2010 | Roddy et al. | |
| 2010/0193184 | A1* | 8/2010 | Dolman | E21B 47/1015 166/253.1 |

* cited by examiner

SYSTEM FOR TRACKING AND SAMPLING WELLBORE CUTTINGS USING RFID TAGS

1. FIELD OF THE INVENTION

The present disclosure relates generally to the recovery of subterranean deposits, and more specifically to a downhole imaging tool having adjustable imaging sensors for use in logging-while-drilling applications and surface data logging systems in completed wells.

2. DESCRIPTION OF RELATED ART

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is typically attached to a drill string that may be rotated to drive the drill bit and within which drilling fluid, referred to as "drilling mud" or "mud", may be delivered downhole. The drilling mud is used to cool and lubricate the drill bit and downhole equipment and is also used to transport any rock fragments or other cuttings to the surface of the well.

As wells are established, it is often useful to obtain information about the well the integrity of the wellbore, and information about cuttings, which are materials removed from the wellbore by a drill bit. Information gathering may be performed using tools that are coupled to or integrated into the drill string.

As referenced herein, the process of measurement while drilling ("MWD)" uses measurement tools to determine formation and wellbore temperatures and pressures, as well as the trajectory of the drill bit. Similarly, the process of "logging while drilling (LWD)" includes using tools to gather data relating to the geological formation surrounding the wellbore to determine formation properties such as permeability, porosity, resistivity, and other properties. Information obtained by MWD and LWD allows operators to make real-time decisions and changes to ongoing drilling operations. In addition to MWD and LWD measurements, a drilling operator may gather information about the drill string by measuring the operating characteristics of different elements in the drill string and the health of the wellbore away from the drill bit to ensure the integrity of the well.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention. It is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The systems and methods described herein provide for the tracking and analyzing of fluids and other materials in a well. The systems may be in the form of wired or wireless tracking systems having a plurality of detectors and wireless transmitters that monitor the behavior of fluids within the well to determine, for example, operating conditions of different elements in the wellbore, the condition of the well casing, and the particular location within the wellbore from which material was cut from the formation by the drill bit ("cuttings"). The system may also measure pump efficiencies, fluid flow characteristics, the well depth from which cutting samples were taken, lag in fluid flows, and leaks within the fluid path that forms the well.

Figure 1:
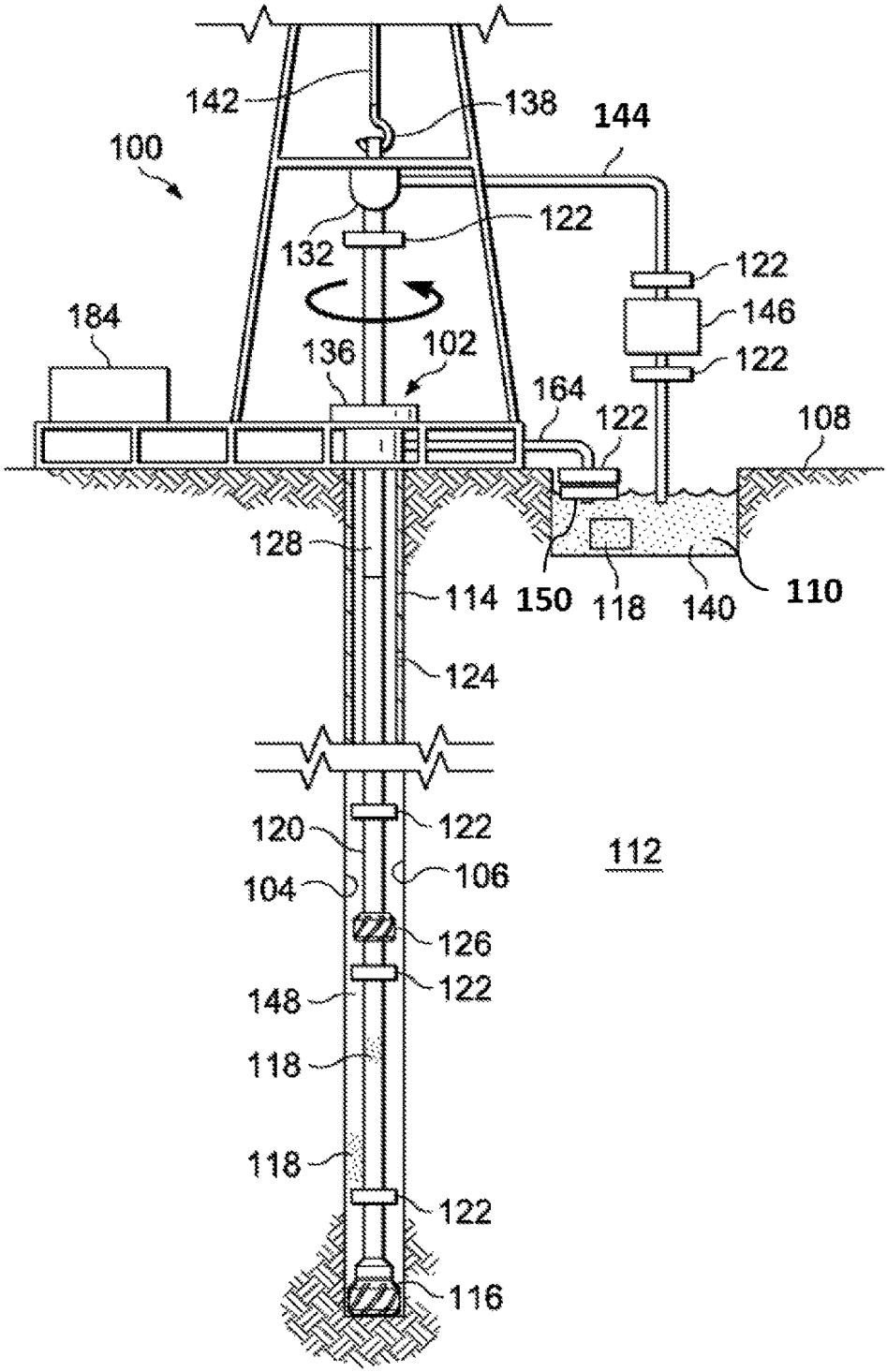
FIG. 1 illustrates a schematic, front view of a well that includes a fluid tracking and sampling system.
Figure 2:
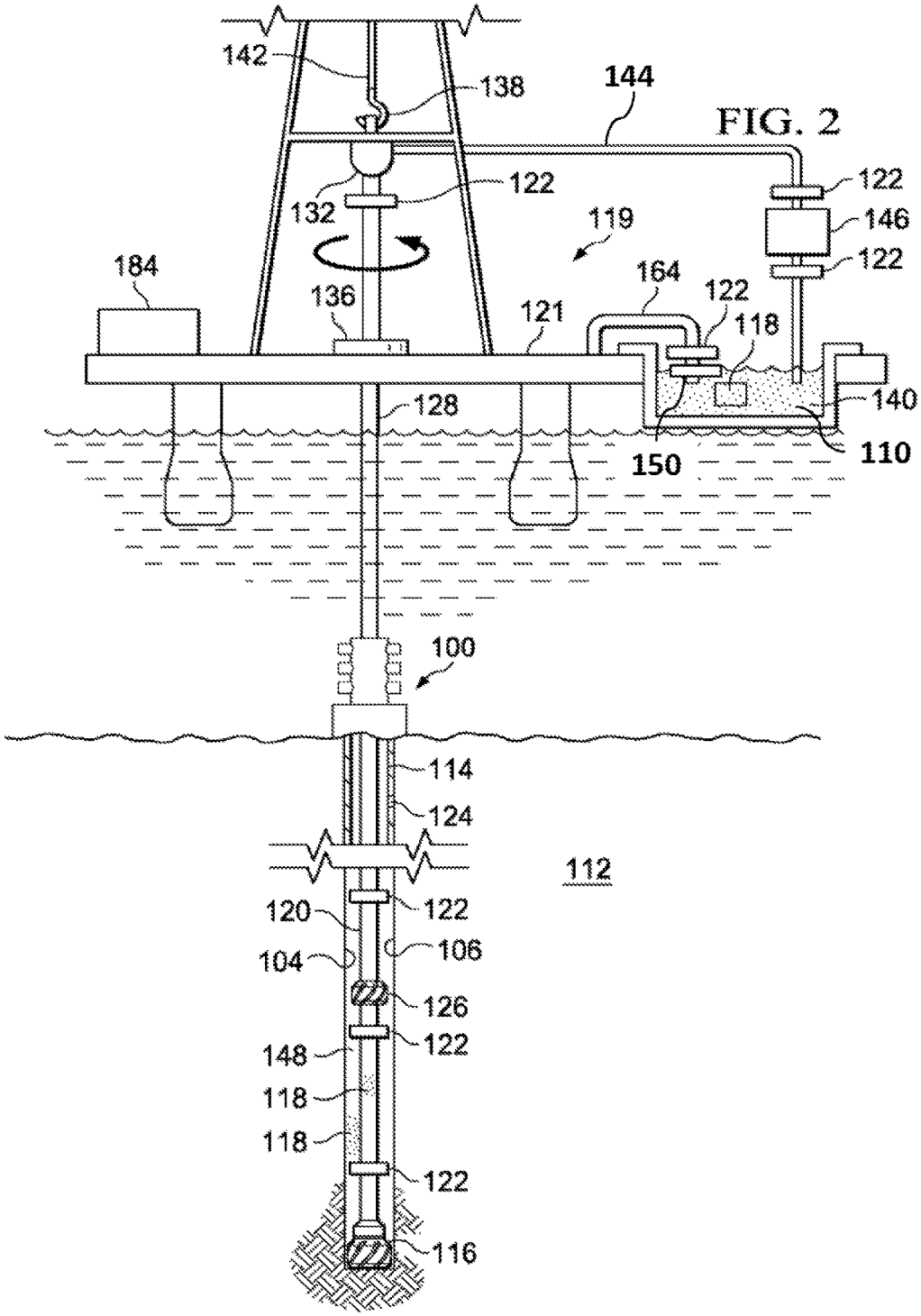
FIG. 2 illustrates a schematic, front view of a subsea well that includes a fluid tracking and sampling system.

Referring to FIG. 1, a fluid sampling system 100 according to an illustrative embodiment is used in a well 102 having a wellbore 106 that extends from a surface 108 of the well 102 to or through a subterranean formation 112. The well 102 is illustrated onshore in FIG. 1 with the fluid sampling system 100 being deployed throughout a wellbore 106 and above-surface elements, though it is noted that in other embodiments, the sampling system need only be deployed in a single portion of the well 102 to be functional. In another embodiment, the fluid sampling system 100 may be deployed in a sub-sea well 119 accessed by a fixed or floating platform 121, as shown in FIG. 2. FIGS. 1 and 2 each illustrate possible uses of the fluid sampling system 100, and while the following description of the fluid sampling system 100 focuses primarily on the use of the fluid sampling system 100 with the onshore well 102 of FIG. 1, the fluid sampling system 100 may be used instead in the well configurations illustrated in FIG. 2, as well as in other well configurations where it is desired to sample a fluid. Similar components in FIGS. 1 and 2 are identified with similar reference numerals.

Any of a variety of drilling processes may be used to drill a well. In the example of FIG. 1, the well 102 is formed by a drilling process in which a drill bit 116 is turned by a drill string 120 that extends from the drill bit 116 to the surface 108 of the well 102. The drill string 120 may be made up of one or more connected tubes or pipes of varying or similar cross-section and may include a reamer 126 at an intermediate location between the drill bit 116 and the surface 108. The drill string 120 may refer to the collection of pipes or tubes as a single component, or alternatively to the individual pipes or tubes that comprise the string. The term drill string is not meant to be limiting in nature and may refer to any component or components that are capable of transferring rotational energy from the surface of the well to the drill bit 116. In several embodiments, the drill string 120 may include a central passage disposed longitudinally in the drill string 120 and capable of allowing fluid communication between the surface 108 of the well and downhole locations. In other embodiments that do not include a drill bit 116, another type of tool string, such as a completion string, a wireline tool string, or a slickline tool string may be used in place of the drill string 120.

Generally, a drilling rig may include a rotary table or a top drive system to rotate a drill string. The particular example illustrated in FIG. 1 uses a rotary table 136. At or near the surface 108 of the well, the drill string 120 may include or be coupled to a kelly 128. The kelly 128 may have a square, hexagonal or octagonal cross-section. The kelly 128 is connected at one end to the remainder of the drill string 120 and at an opposite end to a rotary swivel 132. The kelly passes through the rotary table 136, which is capable of rotating the kelly and thus the remainder of the drill string 120 and drill bit 116. The rotary swivel 132 allows the kelly 128 to rotate without rotational motion being imparted to the rotary swivel 132. A hook 138, cable 142, traveling block (not shown), and hoist (not shown) are provided to lift or lower the drill bit 116, drill string 120, kelly 128 and rotary swivel 132. The kelly and swivel may be raised or lowered as needed to add additional sections of tubing to the drill string 120 as the drill bit 116 advances, or to remove sections of tubing from the drill string 120 if removal of the drill string 120 and drill bit 116 from the well 102 are desired.

The fluid sampling system 100 includes one or more transmitters 118 which, in the embodiment of FIG. 1, are distributed within the drilling fluid 140 or mud that is circulated through the drill string 120. The transmitters 118 may be very small micro-electromechanical sensors ("MEMS") or radio-frequency identification ("RFID") tags, and as such may be sized and configured to act as a fluid particle and flow with the drilling fluid 140 along a fluid flow path that circulates throughout the fluid sampling system. For example, the size, shape, and density of the transmitters 118 may be selected or varied to match cuttings from the drill bit 116 or reamer 126 or fluid particles from a drilling fluid 140. In an embodiment, the transmitters 118 may be as small as two millimeters in width or diameter, or smaller. A distribution of transmitter 118 sizes and shapes may be selected based on the composition of the formation 112 and the size of the bit on the drill bit 120 or reamer 126. The transmitters 118 may be distributed in sufficient quantity to ensure that an adequate number of transmitters 118 will be detected by detectors 122, which may be distributed throughout the system 100, and to overcome losses or damage to transmitters 118 that are circulated in the system 100. The transmitters 118 may be pre-mixed into the drilling fluid 140 in the reservoir 110 or added to the system 100 at different points in the fluid flow path.

As shown in FIG. 1, the drilling fluid 140 is stored in a fluid reservoir 110 and pumped into an inlet conduit 144 using a pump 146, or plurality of pumps positioned along the inlet conduit 144. While the example of FIG. 1 considers that the fluid reservoir 110 includes drilling fluid 140, other types of fluid, such as spacer fluids and cements, may be stored within the reservoir 110 and circulated through the system. In the present example, the drilling fluid 140 passes through the inlet conduit 144 and into the drill string 120 via a fluid coupling at the rotary swivel 132. The drilling fluid 140 is circulated into the drill string 120 to maintain pressure in the drill string 120 and wellbore 106 and to lubricate the drill bit 116 and reamer 126 as they cut material from formation 112 to deepen or enlarge the wellbore 106. After exiting the drill string 120, the drilling fluid 140 carries cuttings, which are the pieces of formation material cut by the drill bit or reamer back to the surface 108 through an annulus 148 formed by the space between the inner wall of the wellbore 106 and outer wall of the drill string 120. At the surface 108, the drilling fluid 140 exits the annulus and is carried to a repository. Where the drilling fluid 140 is recirculated through the drill string 120, the drilling fluid 140 may return to the fluid reservoir 110 via an outlet conduit 164 that couples the annulus 148 to the fluid reservoir 110. The path that the drilling fluid 140 follows from the reservoir 110, into and out of the drill string 120, through the annulus 148, and to the repository may be referred to as the fluid flow path.

To gather information about the flow of the drilling fluid 140 through the fluid sampling system 100, a detector 122 or series of detectors 122 may be distributed along the fluid flow path to detect the presence of the transmitters 118. The detector 122 or type of detector 122 is generally selected based on the transmitter 118 such that the detector 122 will detect the presence of a transmitter 118 and receive identification data transmitted by the transmitter. For example, if the transmitter 118 is an RFID tag or MEMS transceiver, the detector 122 will likely be an RFID tag reader or a scanner that receives data transmitted by a MEMS transceiver.

In an embodiment in which the transmitters 118 are RFID tags and the detectors 122 are RFID tag readers, each RFID tag has the ability to actively or passively transmit data in the presence of the RFID reader. The RFID tags may be powered via a magnetic field generated by the RFID tag reader and, as such, may not require a local power source. Other RFID tags may collect energy from an electrical or magnetic field generated by the RFID tag reader and, in response, act as passive transponders that emit radio waves to transmit identification information to the reader. In an embodiment in which the transmitters 118 are ("micro-electromechanical sensor identification tags ("MEMS-IDs") that are very small and shaped to resemble cuttings generated by the drill bit 116, the detectors 122 are MEMS-ID readers that receive identification data from the MEMS-ID transmitters 118. In addition to RFID and MEMS-ID transmitters, the transmitters 118 may be formed using other suitable technologies, such as nanotechnology. In any case, the transmitters 118 may be formed to be approximately the same size as, or much smaller than, the cuttings removed from the formation 112 to increase the likelihood that they will pass from the drill string 120 through the drill bit 116 and into the annulus 148 without being damaged by the drill bit 116. In an embodiment, transmitters 118 of a plurality of sizes, shapes, and densities may be distributed to, for example, mimic the characteristics of the cuttings removed from the wellbore 106.

Each transmitter 118 may include unique identification information that is transmitted to a detector 122 when the transmitter 118 passes the detector 122. The identification information gathered by the detector 122 may be correlated with a timestamp and the exact location, which may be a depth within the wellbore 106 or a distance relative to the inlet or outlet of the pump 146, for example. Each detector 122 may include a wired or wireless transceiver that communicates couples the detector 122 to a surface controller 184, which may include a computer or processing unit. The surface controller 184 may also include a memory or database to store the identification information, timestamp, and location information transmitted by each detector, which may be referred to as the transmitter data. In another embodiment, each detector 122 may include communication, processing, and memory functionality such that a network of detectors may operate as an ad hoc detector network that communicates with a computing device of the well operator to implement the systems and process described herein.

By circulating a sufficient quantity of transmitters 118 with the drilling fluid 140, the transmitter data may be aggregated to map the flow of drilling fluid 140 through the well 102. As such, the transmitter data may be processed to determine operating characteristics of different elements in the well 102 and fluid flow rates in different regions of the well 102.

Communication between the detectors 122 and the surface controller 184 may be by wire if the drill string 120 is wired. Alternatively, the detectors 122 and surface controller 184 may communicate wirelessly using mud pulse telemetry, electromagnetic telemetry, or any other suitable communication method.

In an embodiment, the transmitters 118 may be added to the fluid flow path by a distributor, which may be assembled with the detector 122 to inject the transmitters 118 into the drilling fluid 140 at or near the inlet conduit 144. In an embodiment, each detector 122 may include a distributor of transmitters 118 along with a bin or other storage source of transmitters 118. Such distributors and bins may also be included at various locations along the fluid flow path corresponding to a material, such as a solid, liquid, or gas to be tracked. The transmitters 118 may be scanned by an additional detector at a coupling between the inlet conduit 144 and the top of the drill string 120 to generate a first set of identification data that includes identification information for the transmitter 118, location data, and a time stamp. In an embodiment, the first set of identification data may also include a velocity and trajectory of the transmitter 118. The transmitters 118 may then be circulated through the drill string 120 and detected by a second detector 122 where they exit the drill string at the reamer 126, drill bit 116, or another flow diverter, such as an LWD tool.

At the second detector 118, the transmitters 118 may be scanned again to generate a second set of identification information that includes the depth at which the transmitters 118 exited the drill string 120. Alternatively, depth information may be calculated using the drill string volume and pump rate, and by solving the following time-to-bit equation to determine the length of the drill string 120:

$$\text{time-to-bit}=((1/4)(\text{pipe inner diameter})^2*\pi*L_i)/\text{pump rate},$$

where $L_i$ is the length of the drill string. From the drill bit 116, the predicted time for the transmitters 118 to reach the surface may be calculated as:

$$\text{time-to-surface}=((1/4)(OD_i^2-ID_i^2)*\pi*L_i)/\text{pump rate},$$

where $ID_i$ is the inner diameter of the annulus 148 and $OD_i$ is the outer diameter of the drill string 120. As discussed in more detail below, the estimated depth and estimated time to surface may be used to make a number of determinations based on the flow of fluid in the drill string 120.

In some instances, a drilling operator may wish to analyze the cuttings or to send the cuttings to a lab to be analyzed in more detail. Thus, in an embodiment, the fluid sampling system 100 may also include an automated sampling system 150 that captures a sample of drilling fluid 140 that includes cuttings and transmitters 118 as they exit the outlet conduit 164. So that the operator may know exactly the location or depth from which the cuttings were removed from the wellbore 106, the identification information associated with the transmitters 118 that are included with the cuttings within the sample of drilling fluid 140 may be accessed and used to identify and catalog the cuttings. Estimated depth data may be used to facilitate this usage of the identification data or a detector 122 may be installed within the drill string 120 adjacent the drill bit 116 to provide actual depth data. If a detector 122 is installed adjacent the drill bit 116, location information and timestamp information associated with the transmitters 118 may indicate the exact depth and time at which the transmitter passes the detector 122, which may be approximately the same as the depth and time at which the cuttings included within the sample were removed from the formation 112.

In addition to providing highly accurate information about the location within the formation from which cuttings were taken, the above-mentioned method of identifying and cataloging samples may alleviate the need for including a detailed label for containers that include the samples because identification information associated with the transmitters 118 within the sample may also function as the sample's label and provide contextual information about the sample. Thus, when a sample is processed in a lab, the lab technician may only need to scan the sampling with a lab-based detector to access previously stored identification information and identify the sample, the formation from which the sample was taken, and the location within the formation from which the sample was taken, including the exact depth at which the cuttings were removed from the wellbore 106.

In an embodiment, signals from the detectors 122 may be aggregated in a data acquisition system that is included offsite or, for example, in the surface controller 184. Based on the received data from the detectors 122 that indicate when cuttings from a particular depth or location in the formation 112 are reaching the surface, an operator or the automated sampling system may select particular cutting samples for further analysis.

Identification information taken from transmitters 118 that are included, or pre-mixed, within drilling fluid 140 in the fluid reservoir 110 may also be used to track times at which the transmitters 118 pass different points within the drill string 120 and wellbore 106. In addition, transmitters 118 may be added to the fluid sampling system from hoppers or other distributors located along the fluid flow path at regular intervals or key locations within the drill string 120 to ensure that an adequate number of transmitters 118 remain in the fluid.

In an embodiment, the detected transmitter data can be analyzed along with pump stroke counts to determine the lag in the system and the pump efficiency. As shown in FIG. 1, for example, detectors 122 may be placed at the inlet and outlet of the pump 146 and the pump efficiency may be calculated as a function of the expected number of transmitters 118 to be detected over a given time period versus the number of transmitters 118 actually detected based on a correlation between the number of transmitters 118 and a unit volume of fluid. For example, the transmitters 118 may be distributed in the fluid at a rate of one transmitter 118 per cubic centimeter of fluid. More or less transmitters 118 may be distributed within the fluid as needed dependent upon the application.

Lag for sections of the fluid flow path may also be computed or estimated using the fluid tracking system by inserting a detector at the beginning and end of the section of interest. Here, lag refers to the amount of time it takes for a particle of drilling fluid 140, which may be approximated by a transmitter 118, to travel from one point in the system to another. Unexpected increases or decreases in the lag or number of pump strokes associated with a particle of drilling fluid 140 traveling from one point in the system to another may indicate problems in the drilling system. For example, increased lag may indicate a washout, losses to the formation 112, or pump malfunction. Similarly, unexpected decreases in lag may indicate an unexpected influx of fluid from another source.

In an embodiment, the washout rate of the system 100 may be calculated by determining the actual number of transmitters 118 to exit the outlet conduit and comparing the actual number to a predicted number of transmitters 118 to exit the outlet conduit, where the predicted number of transmitters 118 is a function of the volume of drilling fluid 140 in the portion of, for example, the annulus 148 and the pump flow rate. Similarly, to monitor fluid losses, transmitters 118 of different sizes, shapes, and densities may be included in the drilling fluid 140. Transmitter identification data may be measured by a detector 122 at the drill bit 116 or at a point in the drill string 120 and again at the surface 108. By generating a distribution of the transmitters 118 circulated into the drill string 120 and a distribution of the transmitters 118 to exit the annulus 148 at the surface, the operator may determine the losses to the formation 112 as well as an indication of the sizes of particles that are being lost to the formation 112, provided that the transmitter identification information includes data that indicates the sizes of the transmitters 118.

By placing detectors 122 at numerous additional points along the fluid flow path, the identification information tracked by the system may also indicate whether the increase lag resulted from a washout, a malfunction, or an influx of fluid from another source. For example, detectors 122 may be placed at the inlet and outlet of the pump 146, and at various points along the interior surface and exterior surface of the drill string 120. For example, detectors 122 may be located at the top of the drill string 120, before and after the reamer 126, adjacent the drill bit 116, at the fluid outlet conduit 164, in MWD, LWD, or wireline tools, at the seafloor (in the case of a subsea installation), at regular intervals in the drill string 120, or near shakers. By correlating the expected lag for one segment of the flow path with lag for other segments of the flow path and the number of pump strokes, an operator may be able to determine whether a pump malfunction, washout, or influx of foreign fluid exists within particular segments of the fluid flow path.

In an embodiment, different types of fluid may be used for different portions of a drilling system. In such an embodiment, identification data associated with transmitters 118 in different types of fluids may be tracked to indicate whether an unwanted mixing of the fluids has occurred. For example, it may be desirable to pump a cement slurry into a portion of the wellbore 106 to set a casing or to seal a portion of the wellbore. In such an embodiment, different types of transmitters 118 may be included within the cement and drilling fluid 140. If a detector 122 simultaneously detects transmitters 118 associated with the cement and transmitters 118 associated with the drilling fluid 140, an operator may be alerted that the cement has not set, or that a seal or casing has failed.

Transmitter identification data may also be used to compute flow rates within different portions of the drill string 120 or wellbore 106. For example, the measured velocity of transmitters 118 may serve as a proxy measurement for the fluid velocity, which may be used to compute the flow rate.

In an embodiment, the fluid sampling system 100 automates fluid sampling using a control system. The control system may include the surface controller 184 or a similar controller located either in the well or remote from the well and coupled to the surface controller 184 via a communications network. The control system may automate the reading and distribution of the transmitters 118 using the detectors 122 which, in the embodiment, may include a hopper or other source of additional transmitters 118 and a distributor to selectively distribute additional transmitters 118 into the fluid flow path when an insufficient quantity of transmitters 118 is detected in the fluid. The additional transmitters 118 may have a variety of sizes and shapes based on the fluid that has been introduced into the wellbore 106. In the embodiment, each fluid will be uniquely tagged with transmitters 118 that include identification information that correlates to the type of fluid in the system. For example, transmitters 118 having unique identifiers may be added to track the flow of drilling fluid 140, a cement slurry, a spacer fluid, or a flush.

At various points in the drilling process, a casing 114 may be set to protect the wellbore 106 using a cement slurry. To prepare the wellbore 106 to receive the cement slurry, a spacer fluid is circulated through the wellbore 106 to fully displace drilling fluid 140 from the annulus 148 and condition the casing 114 and surface of the annulus 148 to accept a cement bond. The spacer fluid may be selected to leave the casing 114 and surface of the annulus 148 water-wet (free of oil), and separate drilling fluids 140 from the cement slurry. To that end, the spacer fluid may be pumped into the wellbore 106 ahead of the cement slurry, possibly with a flush, to thin and disperse drilling fluid 140. In this setting, even a thin layer of oil from the drilling fluid 140 left on the casing 114 or the formation may prevent the cement slurry from directly contacting the surfaces of the casing 114 and annulus 148 and forming a good bond. A properly conditioned wellbore 106 therefore has the best chance for a good cement job and the least chance of annular gas migration problems or costly remediation operations. To increase the likelihood of a good bond, transmitters 118 may be included in the various fluids and associated with the fluid types to indicate the type of fluid that is adjacent the casing 114 prior to circulating the cement slurry to seal the casing 114. In such an embodiment, detectors 122 adjacent the casing 114 may determine from the transmitters 118 that all drilling fluid 140 has been removed from the portion of the wellbore adjacent the casing 114 and that the area is prepared to receive the cement slurry. However, if the detectors 122 detect transmitters 118 that are associated with the drilling fluid 140, then it may be desirable to provide additional spacer fluid to the wellbore 106 until no transmitters 118 associated with the drilling fluid 140 are detected near the casing 114. Upon determining that no transmitters 118 associated with the drilling fluid 140 are adjacent the casing or that only transmitters 118 associated with the spacer are adjacent the casing 114, the controller or well operator may initiate the circulation of the cement slurry to set the casing 114.

To monitor the stability of the casing 114, an additional set of transmitters 118 may be added to the cement slurry. After the casing 114 has been set, the controller may verify that the transmitters 118 associated with the cement are stationary at the casing 114 and not circulating through the wellbore 106. Conversely, if transmitters 118 associated with the previously set cement are detected moving past detectors 122 in the wellbore 106, a controller or well operator may determine that there is a breach 124 or failure in the casing 114.

In an embodiment, a mobile detector (not shown) may be circulated along the drill string 120 or deployed into the wellbore 106 by wireline to map the locations of the individual transmitters set within the wellbore 106. This mapped location information can be stored in a database by the controller and accessed during later operation of the drill string 120 or well 102. If, at a later point in time, a transmitter 118 associated with a set element (e.g., cement) passes a detector 122 to an operator may infer that the set element has become dislodged, and may access the map to determine the exact location from which the transmitter became dislodged to pinpoint the exact location of the breach 124 or other failure.

Additionally, in an embodiment, frequent spacing of detectors 122 in the drill string 120 may help to map the flow of fluids in the wellbore 106, including throughout the drill string 120, with a higher degree of resolution. Without the use of detectors 122 and transmitters 118, a well operator may be forced to rely on computational models to estimate flow characteristics in the well 102. Additionally, by using the transmitters 118 and detectors 122 described herein, empirical data may be collected to validate fluid flow modeling techniques and to monitor flow in real time. This may help to optimize flow in a well by altering the geometry of well components, altering fluid velocities, or altering drilling mud properties to enhance the performance of hydraulic components and maximize the transfer of cuttings from the wellbore 106. For example, liquids, solids, and gases distributed in the wellbore 106 may each be tracked by injecting transmitters 118 from a distributor into the fluid flow path with control volumes of the materials (including gases and liquids) to be tracked. To insert the transmitters 118 into the specific control volumes identified for tracking, a number of transmitter distributors may be included at a variety of locations in in the wellbore 106, thereby enabling the tracking of such gases, liquids and solids as they travel to the surface 108. In each case, depending on whether a well operator desires to track the movement of a solid, liquid, or gas, certain control volumes of fluid may be populated with transmitters that are selected, based on size, shape, and density, to travel through the wellbore 106 with the solid, liquid or gas from a distributor that is located at or near the expected point of origin for the solid, liquid or gas. For example, if a drilling operator desires to track the movement of cuttings, transmitters 118 may be injected into the drilling fluid 140 from a distributor proximate the drill bit 116.

Similarly, frequent spacing of detectors 122 in the fluid flow path may help to reduce the time that the well is non-productive by avoiding failures, enhancing the operation of the drill string 120, and by quickly determining the location of washouts and influxes.

In an embodiment, the detectors 122 and controller (e.g., surface controller 184) may be coupled to an early warning system to warn the well operator of abnormal conditions while drilling or circulating fluid in the wellbore. Such a system may assist a well operator to rapidly respond to unexpected changes in drilling fluid 140 flow or pressure in the drill string 120 or wellbore 106. Such unexpected changes may be determined by distributing transmitters into a fluid flow path in the well bore at a first location, predicting a frequency or transmitter density to be detected at a second location in the fluid flow path at a second time, detecting the transmitters to determine the actual frequency or transmitter density, and comparing the predicted frequency or transmitter density to the actual transmitter frequency or density. Unexpected variations, which may be in the form of increased lag, decreased lag, or decreased transmitter density may provide an indication of a kick, loss of returns, washouts, problems with mechanical elements, or influx of fluid. Such unexpected variations may also indicate that the system is not functioning properly. In such an embodiment, the controller may be coupled to a warning signal or alarm, such as a visual indicator or an audible signal (e.g., a light or siren) to indicate the presence of any one of the aforementioned conditions as determined by monitoring the transmitters. The warning signal or alarm may be provided at the drill site, on a computing device or an operator, or on a remote controller or network that is monitored at a location remote from the drill site.

In another embodiment, detectors 122 and distributors of transmitters 118 may be installed in a completed well and the transmitters 118 may be periodically released to determine flow characteristics of the well or to isolate a washout, or failed well element using the systems and methods described above.

Figure 3:
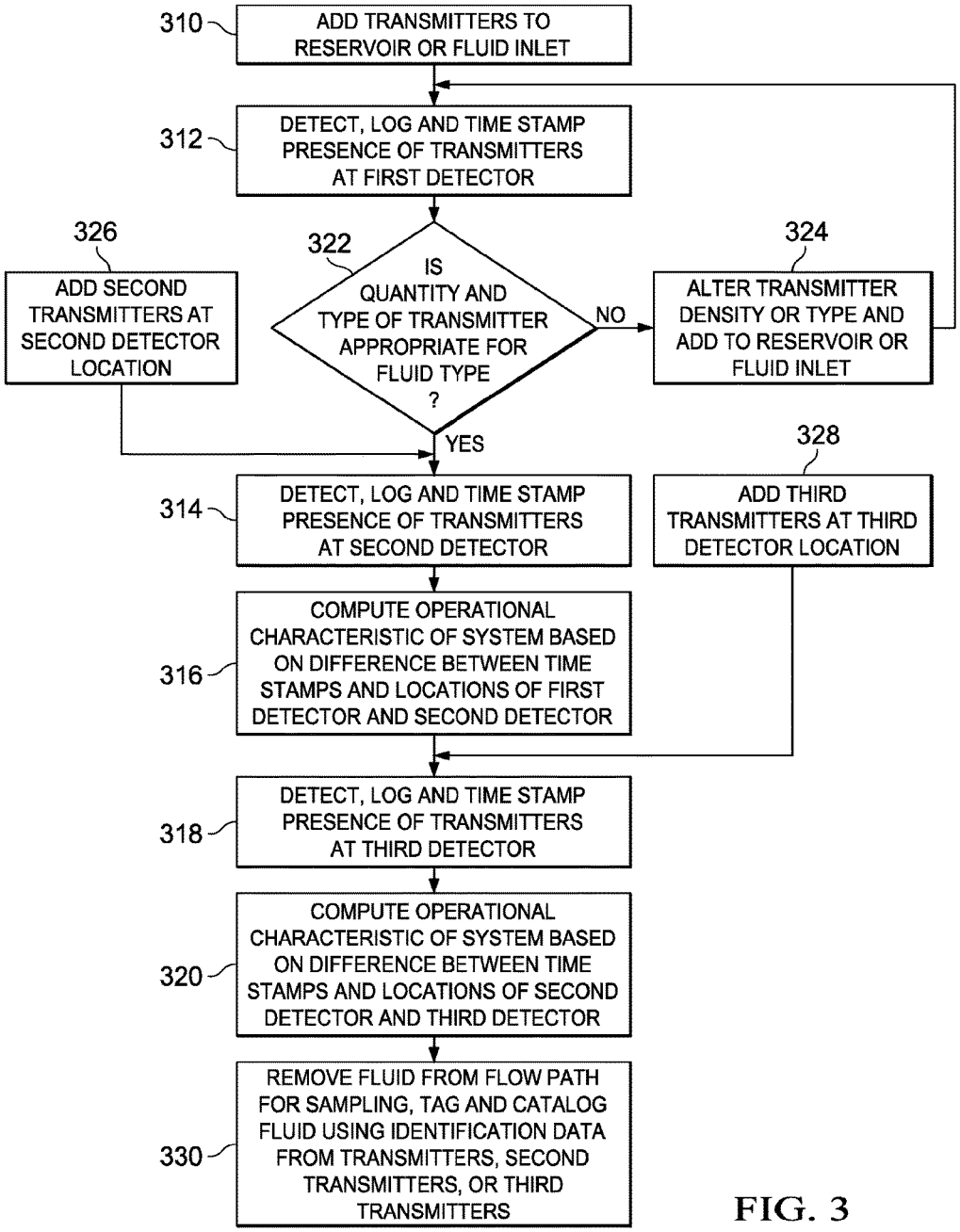
FIG. 3 is a flow chart showing an exemplary method for monitoring a characteristic of one or more elements of a well using a fluid tracking and sampling system.

Referring now to FIG. 3, an illustrative process for monitoring and tracking the flow of fluids through a drill string and wellbore is shown. The process includes adding transmitters to a reservoir by, for example, pre-mixing transmitters with drilling fluid in the reservoir or dispersing transmitters into a fluid flow path 310. In the illustrative process, a first detector located along the fluid flow path that includes a drill string detects the transmitters and logs identification information received from the transmitters and a time stamp 312. The first detector transmits the identification information and time stamp to a control system that stores the transmitted information together with location information that is indicative of the location of the first detector. Based on the type of fluid being circulated along the fluid flow path, the control system may determine whether the quantity and type of transmitters is appropriate for the fluid and other system parameters, such as the composition of the formation and the geometry of drill bit or reamer being used in the drill string 322. If the quantity of transmitters and transmitter type is determined to be appropriate, it may not be necessary to add transmitters to the fluid flow path. If the quantity transmitters and transmitter type is not determined to appropriate, additional transmitters may be added to the fluid flow path 324.

The method also includes detecting the presence of the transmitters at a second detector and recording a time stamp indicative of the time that the transmitters were detected by the second detector 314. By comparing the time stamps generated by the first detector and second detector and the locations of the first detector and second detector, an operator computes an operational characteristic of the system 316. As described above with regard to FIGS. 1 and 2, the operational characteristic may be a flow rate, a pump efficiency, a lag, a washout indication, a loss indication, or another performance parameter of an element in the drill string that relates to the flow of fluid through the drill string or wellbore.

In a system that includes a third detector, the method also includes detecting the transmitters at the third detector and again recording time stamp data indicative of the time that the transmitters were detected by the third detector 318. By comparing time stamp data generated by the third detector or location data indicative of the location of the third detector to the time stamps generated by the first detector and second detector and the locations of the first detector and second detector, an operator computes an additional operational characteristic of the system 320 or validates the operational characteristic determined using the first detector and second detector. It is noted that numerous additional detectors, for example, n detectors, may be included in a similar manner.

In some systems, the process may also include distributing additional transmitters at different points in the drill string or fluid flow path. For example, a second set of transmitters may be distributed into the fluid flow path from a storage and distribution device, such as a hopper at the location of the second detector 326, and a third set of transmitters may be distributed into the fluid flow path from a storage and distribution device at the location of the third detector 328. In an embodiment, the process may include distributing transmitters near the drill bit of the drill string directly into the annulus between the drill string and well bore so that the transmitters will not be damaged by the drill bit.

In an exemplar drilling system in which the fluid and cuttings from the drill bit return to the surface together in the fluid flow path, the process may also include removing fluid from the fluid flow path for sampling, and tagging and cataloging the samples using identification data from transmitters, second transmitters, or third transmitters 330.

It should be apparent from the foregoing that an invention having significant advantages has been provided. While the invention is shown in only a few of its forms, it is not limited to only these embodiments but is susceptible to various changes and modifications without departing from the spirit thereof.

The drilling optimization collar and related systems and methods may be described using the following examples:

Example 1

A system for determining system lag during drilling operations includes a fluid reservoir, a pump, and a drill string having an inlet and an outlet. The system also includes an inlet conduit fluidly coupled to the fluid reservoir and the inlet and an outlet conduit fluidly coupled to the fluid reservoir and the outlet. A first detector is positioned along the inlet conduit and operable to detect the presence of one or more transmitters, a second detector is also positioned along the tool string and operable to detect the presence of the one or more transmitters. A third detector may also positioned along the outlet conduit and operable to detect the presence of the one or more transmitters. Fluid is circulated in a fluid flow path that fluidly couples the fluid reservoir, the pump, the drill string, the inlet conduit, and the outlet conduit. To assist in the operation of the system a processing unit communicatively is coupled to the first detector, second detector, and third detector. The processing unit is operable to determine the time for the one or more transmitters to travel from the first detector to the second detector, and from the second detector to the third detector.

Example 2

The system of example 1, wherein the drill string comprises a drill bit and the second detector is disposed adjacent the drill bit.

Example 3

The system of examples 1 and 2, wherein, the first detector comprises a transmitter distributor that distributes the one or more transmitters into the fluid at a point along the inlet conduit.

Example 4

The system of examples 1-3, wherein, the distributor comprises a hopper and the one or more transmitters comprises sensors of varying size and shape, and wherein the hopper automatically distributes sensors of various sizes and shapes into the wellbore based on the composition of the fluid.

Example 5

The system of examples 1-4, wherein the fluid comprises a plurality of fluids, and wherein each of the plurality of fluids may be uniquely tagged with a transmitter that is numbered and indexed to correspond to the fluid.

Example 6

The system of examples 1-5, wherein the transmitter distributor comprises a MEMS distributor, and wherein the one or more transmitters comprise MEMS.

Example 7

The system of examples 1-5, wherein the transmitter distributor comprises an RFID tag distributor, and wherein the one or more transmitters comprise RFID tags.

Example 8

The system of examples 1-7, wherein the one or more transmitters are pre-mixed within the fluid.

Example 9

The system of examples 1-8, further comprising a sampling subsystem that automatically gathers fluid samples from the outpoint conduit, the sampling subsystem comprising sampling containers, wherein the processing unit automatically tags each sampling container based on a unique identifier associated with a subset of the one or more transmitters that resides within the fluid sample.

Example 10

The system of examples 1-9, wherein the first detector is disposed adjacent an inlet of the pump and the second detector is disposed adjacent the outlet of the pump, and wherein the processing unit is operable to compute the efficiency of the pump based on data received from the first detector and second detector.

Example 11

The system of examples 1-10, further comprising a well casing, the well casing comprising a plurality of second transmitters, wherein the of the first detector, second detector, and third detector are operable to determine if there is mixing between the one or more transmitters and the plurality of second transmitters.

Example 12

The system of example 11, In an embodiment, the well casing comprises a fourth detector, the fourth detector being operable to determine if there is mixing between the one or more transmitters and the plurality of second transmitters.

Example 13

The system of examples 1-12, wherein the processing unit is operable to receive data during a drilling process by associating MEMS or RFID devices in the fluid with samples of cuttings, to determine system lag and pump efficiency, to determine influxes, losses, and washouts, and to troubleshoot flow in particular sections of a well.

Example 14

A system for monitoring flow in a well that includes a fluid flow path having an inlet and an outlet; a first detector disposed at a first location along the fluid flow path to detect the presence of one or more transmitters; a second detector disposed at a second location along the fluid flow path to detect the presence of the one or more transmitters; one or more distributors operable to distribute the transmitters into the fluid flow path; and a processing unit communicatively coupled to the first detector and second detector, wherein the processing unit is operable to determine the time for the one or more transmitters to travel from the first detector to the second detector, and from the second detector to the third detector.

Example 15

The system of example 14, wherein the one or more distributors comprise hoppers and the one or more transmitters comprise sensors of varying size and shape, and wherein the hopper automatically distributes sensors of various sizes and shapes into the wellbore based on the expected composition of a fluid in the fluid flow path.

Example 16

The system of examples 14-15, wherein the fluid comprises a plurality of fluids, and wherein each of the plurality of fluids may be uniquely tagged with a transmitter that is numbered and indexed to correspond to the fluid.

Example 17

The system of examples 14-16, wherein the transmitter distributor comprises a MEMS distributor, and wherein the one or more transmitters comprise MEMS.

Example 18

The system of examples 14-17, wherein the system further comprises a sampling subsystem that automatically gathers fluid samples from the outlet, the sampling subsystem comprising sampling containers, wherein the processing unit automatically tags each sampling container based on a unique identifier associated with a subset of the one or more transmitters that resides within the fluid sample.

Example 19

The system of examples 14-18, wherein the system further comprises a well casing, the well casing comprising a plurality of second transmitters, wherein one of the first detector and second detector is operable to determine if there is mixing between the one or more transmitters and the plurality of second transmitters.

Example 20

A method for sampling cuttings from a wellbore that includes installing a detector at a first location in a fluid flow path that includes a drill string. The method also includes distributing a transmitter into the fluid flow path and detecting the transmitter using the detector by receiving identification data from the transmitter and recording the identification data, location data, and a time stamp. In addition, the method includes transmitting the identification data, the location data, and the time stamp to a control system that stores the identification data, the location data, and the time stamp. The method further includes determining a location at which the transmitter exits the drill string and capturing a sample of fluid, wherein the sample comprises the fluid, the transmitter, and one or more cuttings from the location at which the transmitter exited the drill string and identifying the sample with identification information in the control system.

Example 21

The method of example 20, further comprising installing a second detector at the location at which the transmitter exits the drill string, detecting the transmitter using the second detector, and transmitting the identification data, second location data, and a second time stamp from the second detector to the control system that stores the identification data, the second location data, and the second time stamp, wherein determining the location at which the transmitter exits the drill string comprises accessing the second location data.

Example 22

The method of examples 20-21, wherein determining the location at which the transmitter exits the drill string comprises calculating an estimate of the location at which the transmitter exits the drill string based on the length of the drill string and a pump flow rate.

Example 23

The method of examples 20-22, wherein the first detector is located at a pump outlet of a pump, the method further comprising distributing a plurality of second transmitters into the fluid flow path and determining the efficiency of the pump by comparing an expected number of second transmitters to a detected number of second transmitters.

Example 24

The method of examples 21-23, further comprising installing a third detector at an intermediate point in the fluid flow path between the inlet of the drill string and the second detector, detecting the transmitter using the third detector, and transmitting the identification data, third location data, and a third time stamp from the third detector to the control system, and determining a lag time for the flow of fluids through the drill string corresponding to the difference between the second time stamp and the third time stamp.

Example 25

The method of example 24, further comprising comparing the determined lag time to an expected lag time to determine whether there is a washout.

Example 26

The method of examples 24-25, further comprising determining the number of second transmitters to be detected by the third detector during a time period, determining the number of second transmitters to be detected by the second detector during the time period, and determining whether there is a loss in the drill string by comparing the number of second transmitters to be detected by the third detector during the time period to the number of second transmitters to be detected by the second detector during the time period.

Example 27

The method of examples 21-26, further comprising distributing the transmitter and second transmitters into the fluid flow path at a point along an inlet conduit.

Example 28

The method of example 27, wherein distributing the transmitter and second transmitters comprises distributing the transmitter and second transmitters from a hopper.

Example 28

The method of examples 23-28, wherein the second transmitters comprise a variety of sizes and shapes based on the composition of the fluid, the composition of the formation, and characteristics of a drill bit.

We claim:

1. A system for determining system lag during drilling operations, the system comprising:

a fluid reservoir; a drill string having an inlet and an outlet; an inlet conduit fluidly coupled to the fluid reservoir and the inlet;

an outlet conduit fluidly coupled to the fluid reservoir and the outlet;

a first detector positioned along the inlet conduit and operable to detect the presence of one or more transmitters;

a second detector positioned along the drill string and operable to detect the presence of the one or more transmitters;

a third detector positioned along the outlet conduit and operable to detect the presence of the one or more transmitters;

a fluid flow path that fluidly couples the fluid reservoir, the drill string, the inlet conduit, and the outlet conduit; and a processing unit communicatively coupled to the first detector, second detector, and third detector, wherein the processing unit is operable to determine the time for the one or more transmitters to travel from the first detector to the second detector, and from the second detector to the third detector.

2. The system of claim 1, wherein the first detector comprises a transmitter distributor that distributes the one or more transmitters into the fluid flow path at a point along the inlet conduit.

3. The system of claim 1, further comprising a fluid within the fluid flow path, wherein the distributor comprises a hopper and the one or more transmitters comprises sensors of varying size and shape, and wherein the hopper automatically distributes sensors of various sizes and shapes into the wellbore based on the composition of the fluid.

4. The system of claim 3, wherein the fluid comprises a plurality of fluids, and wherein each of the plurality of fluids may be uniquely tagged with a transmitter that is numbered and indexed to correspond to the fluid.

5. The system of claim 3, wherein the one or more transmitters are pre-mixed within the fluid.

6. The system of claim 1, further comprising a sampling subsystem that automatically gathers fluid samples from the outlet conduit, the sampling subsystem comprising sampling containers, wherein the processing unit automatically tags each sampling container based on a unique identifier associated with a subset of the one or more transmitters that resides within the fluid samples.

7. The systems of claim 1, wherein the one or more transmitters comprise micro-electromechanical sensors or radio-frequency identification devices and wherein the processing unit is operable to receive data during a drilling process by deploying the micro-electromechanical sensors or radio-frequency identification devices into the fluid flow path, associating samples of cuttings with the micro-electromechanical sensors or radio-frequency identification devices, to determine system lag and pump efficiency, to determine influxes, losses, and washouts, and to troubleshoot flow in particular sections of a well.

8. A system for monitoring flow in a well, the system comprising:

a fluid flow path having an inlet and an outlet; a first detector disposed at a first location along the fluid flow path to detect the presence of a plurality of transmitters, wherein the transmitters comprise a plurality of first transmitters and a plurality of second transmitters;

a second detector disposed at a second location along the fluid flow path to detect the presence of the transmitters; and one or more distributors is configured to distribute the transmitters into the fluid flow path; and a processing unit communicatively coupled to the first detector and second detector, wherein the processing unit is configured to determine the time for the transmitters to travel from the first detector to the second detector, wherein a first fluid in the fluid flow path is uniquely tagged with the first transmitters and a second fluid in the fluid flow path is uniquely tagged with the second transmitters.

9. The system of claim 8, wherein the one or more distributors comprise hoppers and the transmitters comprise sensors of varying size and shape, and wherein the hopper automatically distributes sensors of various sizes and shapes into the wellbore based on the expected composition of a fluid in the fluid flow path.

10. The system of claim 8, wherein the first transmitters are numbered and indexed to correspond to the first fluid and the second transmitters are numbered and indexed to correspond to the second fluid.

11. The system of claim 8, wherein the distributor comprises a micro-electromechanical sensors distributor, and wherein the transmitters comprise micro-electromechanical sensors.

12. The system of claim 8, further comprising a sampling subsystem that automatically gathers fluid samples from the outlet, the sampling subsystem comprising sampling containers, wherein the processing unit automatically tags each sampling container based on a unique identifier associated with a subset of the transmitters that resides within the fluid sample.

13. A system for monitoring flow in a well, the system comprising:

a fluid flow path having an inlet and an outlet; a first detector disposed at a first location along the fluid flow path to detect the presence of transmitters;

a second detector disposed at a second location along the fluid flow path to detect the presence of the transmitters;

one or more distributors configured to distribute the transmitters into the fluid flow path; and a processing unit communicatively coupled to the first detector and second detector, wherein the processing unit is configured to determine the time for the transmitters to travel from the first detector to the second detector, and from the second detector to the third detector; and a well casing, the well casing comprising a plurality of second transmitters, wherein one of the first detector and second detector is configured to determine if there is mixing between the transmitters and the plurality of second transmitters.

14. A method for sampling cuttings from a wellbore, the method comprising:

installing a detector at a first location in a fluid flow path, the fluid flow path comprising a drill string;

distributing a transmitter into the fluid flow path;

detecting the transmitter using the detector, wherein detecting the transmitter comprises receiving identification data from the transmitter and recording the identification data, location data corresponding to the location of the transmitter, and a time stamp;

transmitting the identification data, the location data, and the time stamp to a control system that stores the identification data, the location data, and the time stamp;

determining a location at which the transmitter exits the drill string;

capturing a sample of fluid, wherein the sample comprises the fluid, the transmitter, and one or more cuttings from the location at which the transmitter exited the drill string; and identifying the sample with identification information in the control system, wherein determining the location at which the transmitter exits the drill string comprises calculating an estimate of the location at which the transmitter exits the drill string based on the length of the drill string and a pump flow rate.

15. The method of claim 14, further comprising installing a second detector at the location at which the transmitter exits the drill string, detecting the transmitter using the second detector, and transmitting the identification data, second location data, and a second time stamp from the second detector to the control system that stores the identification data, the second location data, and the second time stamp, wherein determining the location at which the transmitter exits the drill string comprises accessing the second location data.

16. The method of claim 14, further comprising:

installing a second detector at a second location in the fluid flow path, the second location being downstream from the first location;

detecting the transmitter using the second detector, wherein detecting the transmitter with the second detector comprises receiving identification data from the transmitter and recording the identification data, location data corresponding to the location of the transmitter, and a time stamp; and determining fluid flow characteristics based on a comparison between the recorded data from the detectors at the first and second locations.

17. A method for sampling cuttings from a wellbore, the method comprising:

installing a detector at a first location in a fluid flow path, the fluid flow path comprising a drill string;

distributing a transmitter into the fluid flow path;

detecting the transmitter using the detector, wherein detecting the transmitter comprises receiving identification data from the transmitter and recording the identification data, location data corresponding to the location of the transmitter, and a time stamp;

transmitting the identification data, the location data, and the time stamp to a control system that stores the identification data, the location data, and the time stamp;

determining a location at which the transmitter exits the drill string;

capturing a sample of fluid, wherein the sample comprises the fluid, the transmitter, and one or more cuttings from the location at which the transmitter exited the drill string; and identifying the sample with identification information in the control system, wherein the detector is located at a pump outlet of a pump, further comprising distributing a plurality of second transmitters into the fluid flow path and determining the efficiency of the pump by comparing an expected number of second transmitters to a detected number of second transmitters.

18. The methods of claim 17, further comprising installing a third detector at an intermediate point in the fluid flow path between an inlet of the drill string and the second detector, detecting the transmitter using the third detector, and transmitting the identification data, third location data, and a third time stamp from the third detector to the control system, and determining a lag time for the flow of fluids through the drill string corresponding to the difference between the second time stamp and the third time stamp.

19. The method of claim 18, further comprising comparing the determined lag time to an expected lag time to determine whether there is a washout.

20. The method of claim 18, further comprising determining the number of second transmitters to be detected by the third detector during a time period, determining the number of second transmitters to be detected by the second detector during the time period, and determining whether there is a loss in the drill string by comparing the number of second transmitters to be detected by the third detector during the time period to the number of second transmitters to be detected by the second detector during the time period.

* * * * *